US010072806B1

(12) United States Patent
Yarnell

(10) Patent No.: US 10,072,806 B1
(45) Date of Patent: Sep. 11, 2018

(54) LUMINAIRE DOWNLIGHT

(71) Applicant: Kenneth Edward Yarnell, Benicia, CA (US)

(72) Inventor: Kenneth Edward Yarnell, Benicia, CA (US)

(73) Assignee: Cooper Technologies Company, Houston, TX (US)

( * ) Notice: Subject to any disclaimer, the term of this patent is extended or adjusted under 35 U.S.C. 154(b) by 164 days.

(21) Appl. No.: 15/144,654

(22) Filed: May 2, 2016

Related U.S. Application Data

(60) Provisional application No. 62/155,134, filed on Apr. 30, 2015.

(51) Int. Cl.

| | |
|---|---|
| ***F21V 29/00*** | (2015.01) |
| ***F21S 8/06*** | (2006.01) |
| ***F21V 17/14*** | (2006.01) |
| ***F21V 5/04*** | (2006.01) |
| ***F21V 1/14*** | (2006.01) |
| ***F21V 7/04*** | (2006.01) |
| ***F21V 29/77*** | (2015.01) |

(52) U.S. Cl.
CPC ..... *F21S 8/06* (2013.01); *F21V 1/143* (2013.01); *F21V 5/04* (2013.01); *F21V 7/04* (2013.01); *F21V 17/14* (2013.01); *F21V 29/77* (2015.01)

(58) Field of Classification Search
CPC ..... F21S 8/06; F21S 8/02; F21S 8/022; F21S 8/024; F21S 8/026; F21S 8/028; F21V 29/77; F21V 7/04; F21V 5/04; F21V 17/14; F21V 1/143; F21V 15/00; F21V 15/01; F21V 15/04
USPC ..... 362/362
See application file for complete search history.

(56) References Cited

U.S. PATENT DOCUMENTS

| | | | | |
|---|---|---|---|---|
| 2009/0080189 | A1* | 3/2009 | Wegner | F21S 8/02 362/235 |
| 2012/0250302 | A1* | 10/2012 | Edwards | F21V 31/005 362/223 |
| 2014/0098539 | A1* | 4/2014 | Inaba | F21S 48/1154 362/277 |
| 2015/0219325 | A1* | 8/2015 | Clark | F21V 21/047 362/294 |
| 2016/0230937 | A1* | 8/2016 | Kim | F21V 19/04 |

* cited by examiner

*Primary Examiner* — Elmito Breval
*Assistant Examiner* — Omar Rojas Cadima
(74) *Attorney, Agent, or Firm* — King & Spalding LLP

(57) ABSTRACT

A luminaire downlight includes a housing and an outer ring that is disposed below and coupled to the housing using one or more fasteners. The outer ring secures one or more extension arms to the housing. The one or more extension arms are adapted to secure a shade to the luminaire downlight. Further, the luminaire downlight includes a light module that is disposed within and coupled to the housing via the outer ring. In particular, an inner surface of the outer ring is indexed to twist and lock the light module to the housing. Furthermore, the luminaire downlight includes a twist lock ring that is coupled to an inner surface of the light module. Additionally, the luminaire downlight includes a lens that is disposed below the outer ring and coupled to the twist lock ring.

17 Claims, 11 Drawing Sheets

FIGURE 5C
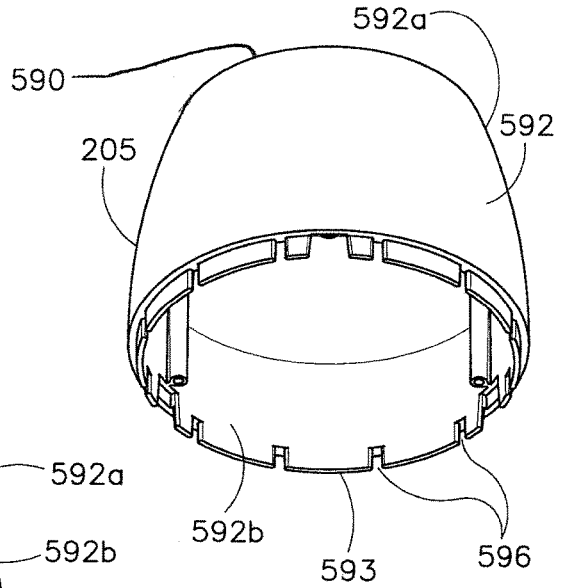
FIGURE 5A
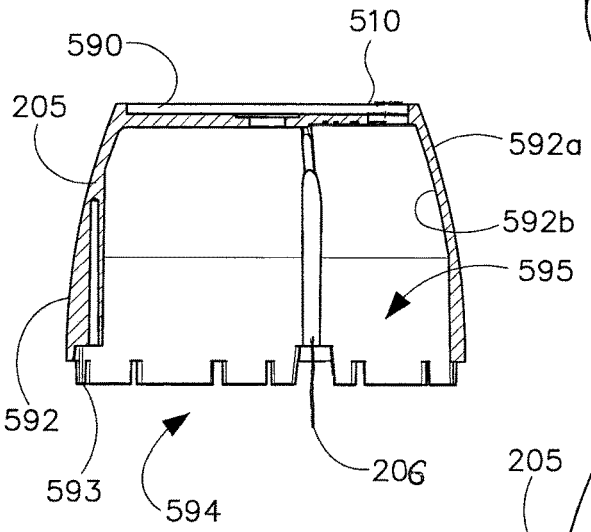
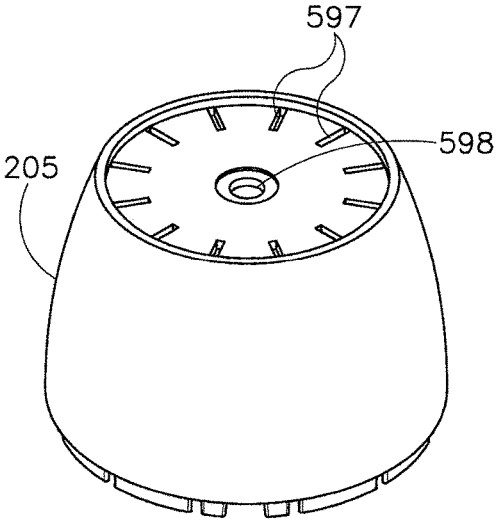
FIGURE 5D
FIGURE 5B
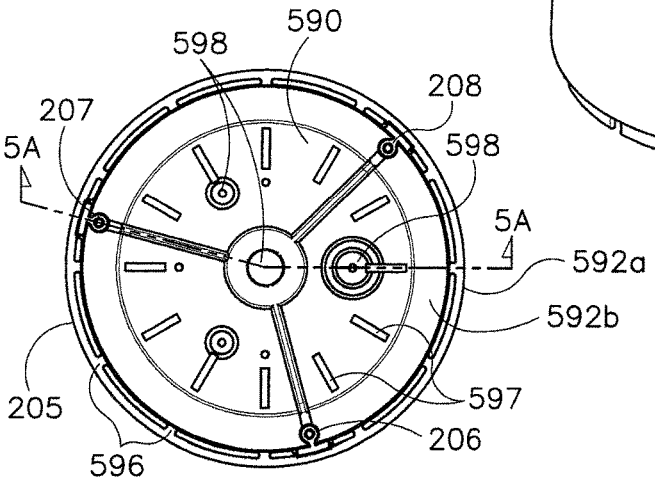

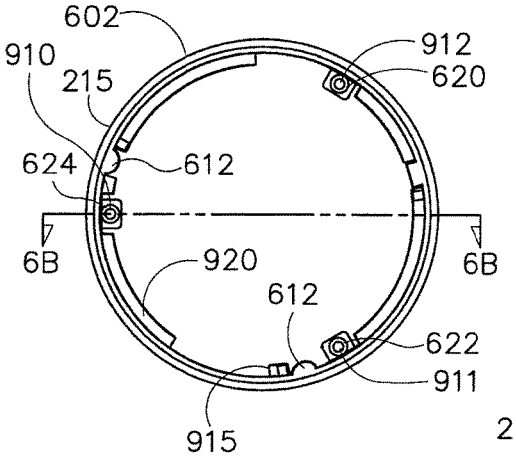
FIGURE 6A
FIGURE 6C
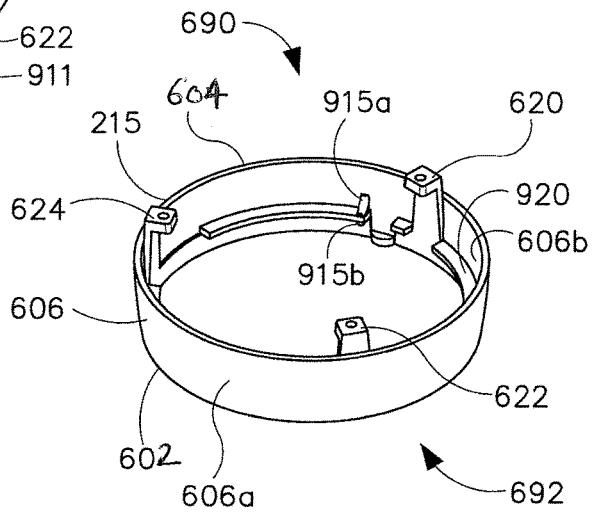
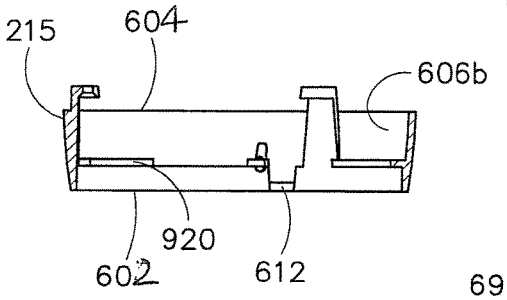
FIGURE 6B
FIGURE 6D
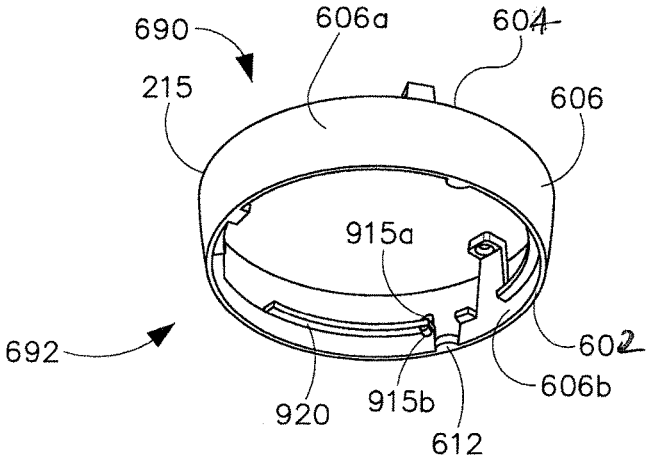

LUMINAIRE DOWNLIGHT

CROSS REFERENCE TO RELATED APPLICATIONS

This non-provisional patent application claims priority under 35 U.S.C. § 119 to U.S. Provisional Patent Application No. 62/155,134, titled 'Luminaire Downlight,' filed on Apr. 30, 2015, which is hereby fully incorporated herein by reference.

TECHNICAL FIELD

Embodiments relate generally to lighting solutions, and more particularly to systems, methods, and devices for an integral and stand-alone downlight.

BACKGROUND

Conventional luminaires often have a lens that serves to modify the light exiting the luminaire. The lens is often designed to cover the electrical and mechanical components within the luminaire so that they are not visible from the exterior of the luminaire. As a result, the lens is often designed to be much larger than necessary to hide the electrical and mechanical components within the luminaire. Further, conventional luminaires that are typically designed to be stand-alone luminaires are not configured to be attached to multiple decorative features, such as shades, trims, etc., and are not flexible/adaptable to accommodate future designs. Similarly, conventional luminaires that are typically designed for decorative applications are not configured to be stand-alone luminaires. Therefore, a need exists for a versatile luminaire downlight that can be used in multiple decorative applications as well as a stand-alone design and be adaptable to future designs. Furthermore, a needs exists for an improved luminaire downlight that minimizes the dimensions of the electrical and mechanical components in the luminaire and thereby minimizes the size of the lens used in the luminaire.

SUMMARY

In one aspect, the present disclosure can relate to a luminaire. The luminaire includes a downlight. In particular, the downlight includes a housing assembly that is configured to secure one or more extension arms to the housing. The housing assembly includes a housing and an outer ring that is disposed below and coupled to the housing. Further, the downlight includes a light module that is received and securely retained within the housing assembly. Furthermore, the downlight includes a twist lock ring that is coupled to an inner surface of the light module and a lens that attaches to the twist lock ring.

In another aspect, the present disclosure can relate to a luminaire. The luminaire includes a shade. Further, the luminaire includes a downlight. In particular, the downlight includes a housing assembly, a light module mounted within the housing assembly, and a lens coupled to the housing. Furthermore, the luminaire includes one or more extension arms securing the shade to the downlight.

These and other aspects, objects, features, and embodiments will be apparent from the following description and the appended claims.

BRIEF DESCRIPTION OF THE FIGURES

The foregoing and other features and aspects of the disclosure are best understood with reference to the following description of certain example embodiments, when read in conjunction with the accompanying drawings, wherein:

FIGS. 5A-5D (collectively 'FIG. 5') illustrate various views of the housing, in accordance with the example embodiments described herein;

FIGS. 6A-6D (collectively 'FIG. 6') illustrate various views of the outer ring, in accordance with the example embodiments described herein;

Figure 1A:
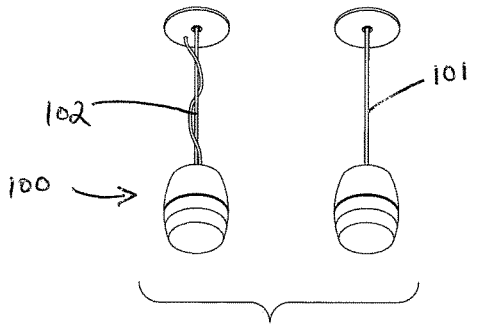
FIGS. 1A-1E (collectively 'FIG. 1') illustrate various example embodiments of the downlight fixture in both stand-alone mode and for decorative application mounted using different mounting mechanisms, in accordance with the example embodiments described herein.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure is directed to an integral and stand-alone downlight (hereinafter "downlight fixture"). In one example, the downlight fixture includes a multi-piece injection molded housing (hereinafter "housing") that is configured to hold/house a light module having a light source, such as one or more LEDs, an LED Chip On Board (COB), or any other appropriate light source. Further, the downlight fixture includes a lens assembly that is coupled to and disposed below the light module. The lens assembly is configured to distribute light from the light source of the light module in various ways as needed. In particular, the lens assembly includes a reflector and a drop lens that are coupled to the downlight fixture via the twist lock ring. For example, the reflector couples to the top portion of the twist lock ring, while the drop lens couples to the bottom portion of the twist lock ring. Then, the twist lock ring with the reflector and the drop lens is coupled to the light module using a twist and lock mechanism. Furthermore, the downlight fixture includes one or more mounting/extension arms of various lengths and formats that are removably coupled to the housing to enable various decorative features such as, alternate shades, diffusers, tubes and trims, to be coupled to the downlight fixture. That is, the removably coupled mounting/extension arms (hereinafter 'extension arms') allow the downlight fixture to be mounted as both a stand-alone fixture and a decorative fixture having additional decorative features, such as shades, diffusers, etc. Additionally, the downlight fixture is designed to allow different types of mounting such as stem mounting, cord mounting, aircraft cable mounting, surface mounting, etc.

Even though the present disclosure is directed towards downlight fixture, one of ordinary skill in the art can understand and appreciate that the teachings described herein can be applied to other types of luminaires or light fixtures. Further, even though the present disclosure describes LED light sources, one of ordinary skill in the art can understand and appreciate that the light source can include any other appropriate point or non-point light source without departing from a broader scope of the present disclosure. Furthermore, even though the present disclosure describes a drop lens, one of ordinary skill in the art can understand and appreciate that alternate embodiments can include any other appropriate lens that allows distribution of light from the light source in various ways without departing from a broader scope of the present disclosure.

The technology of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "example embodiments" given herein are intended to be non-limiting and among others supported by representations of the present technology.

Figure 1B:
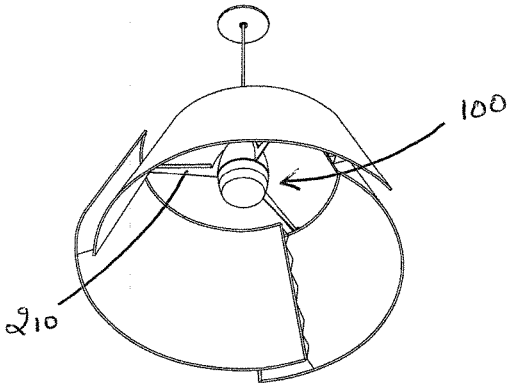
Figure 1C:
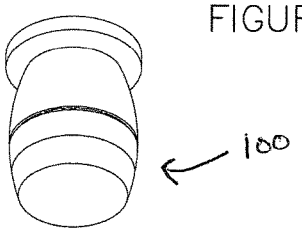
Figure 1D:
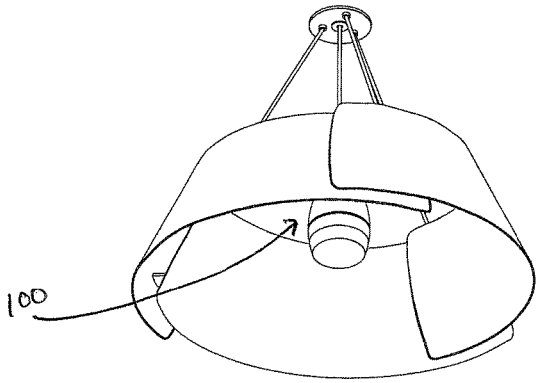
Figure 1E:
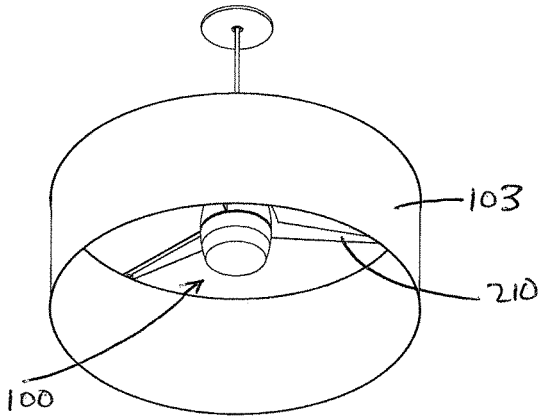

Turning to FIGS. 1A-1E, these figures illustrate various example embodiments of the downlight fixture, in both stand-alone mode and decorative applications, mounted using different mounting mechanisms, in accordance with the example embodiments described herein. For example, as illustrated in FIG. 1A, the downlight fixture 100 may be a stand-alone light fixture that is suspension mounted from a surface, e.g., ceiling, using a rigid stem 101 or flexible cable 102, such as a portable SJ cord with multiple conductors used for temporary electrical power connections requiring flexibility. Alternatively, as illustrated in FIG. 1C, in certain embodiments the downlight fixture 100 may be mounted as a stand-alone fixture directly to a surface (surface mounting). In yet other embodiments, the downlight fixture 100 may support a variety of decorative features, such as shades (e.g., fabric shades 103), diffusers, etc., that can be coupled to the downlight fixture 100 with or without extension arms 210, as illustrated in FIGS. 1B, 1D, and 1E. The downlight fixture 100 and the extension arms 210 are described below in greater detail in association with FIG. 2.

Figure 2:
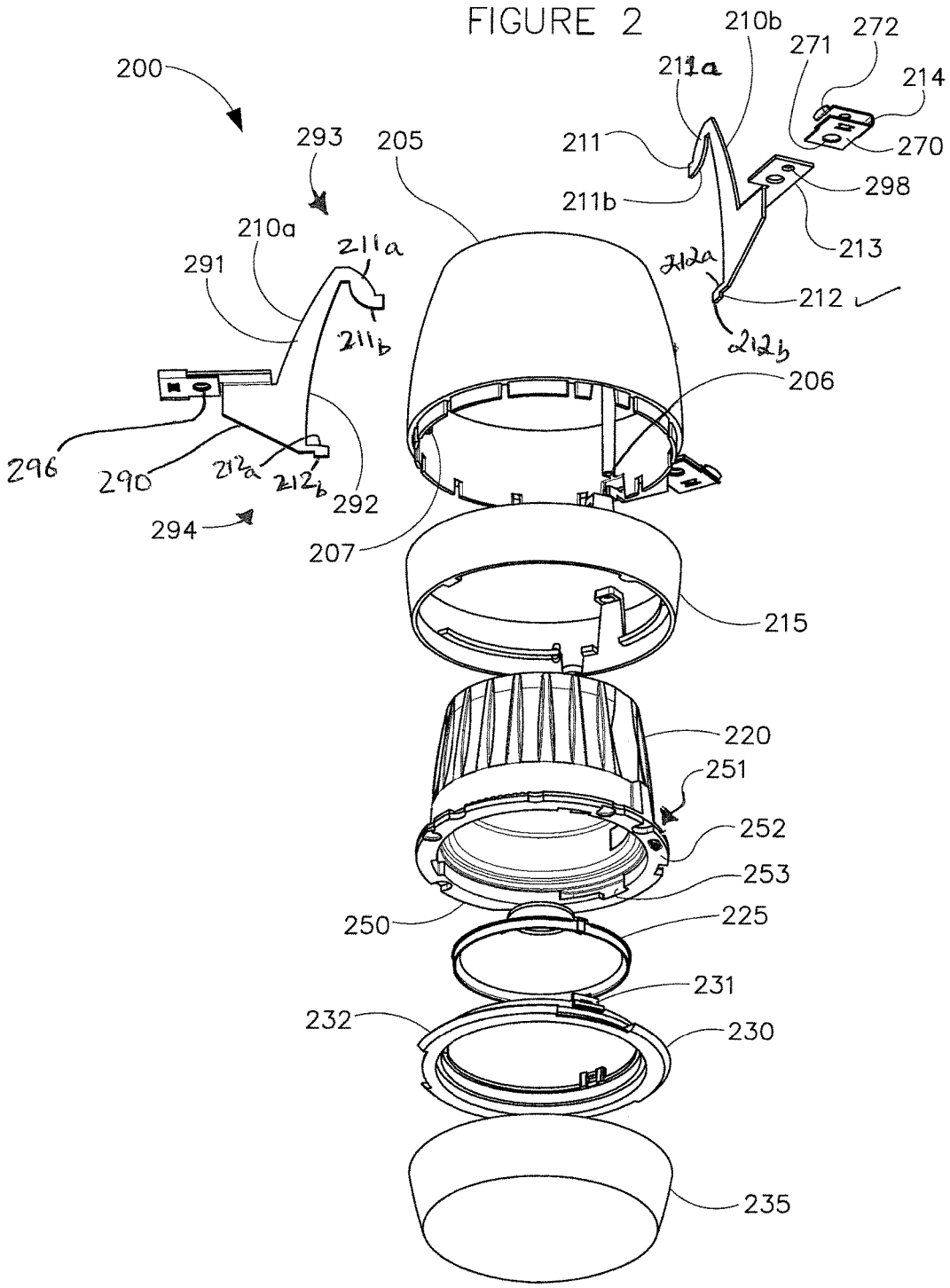
FIG. 2 illustrates an exploded view of an integral and stand-alone downlight, in accordance with the example embodiments described herein.

Turning to FIG. 2, this figure illustrates an exploded view of a downlight fixture 200, in accordance with the example embodiments described herein. The example downlight 200 shown in FIG. 2 includes a housing 205, extension arms 210*a* and 210*b*, an outer ring 215, a light module 220, a reflector 225, an inner ring 230, and a lens 235. Other embodiments of the downlight fixture may have fewer, additional, or different components than those shown in FIG. 2. For example, an alternate embodiment of a downlight fixture 200 may omit the inner ring 230 (hereinafter 'twist lock ring') and the lens may be secured directly to the light module 220.

In the example embodiment shown in FIG. 2, the housing 205 may include a plurality of bosses 206, 207, and/or 208 to which the outer ring 215 can be secured by using fasteners, such as screws, to form a housing assembly 201 that is configured to house the light module 220. The housing 205 and the outer ring 215 are described below in greater detail in association with FIGS. 5 and 6.

Turning now to FIGS. 5A-5D, these figures illustrate various views of the housing, in accordance with the example embodiments described herein. In particular, FIG. 5A illustrates a cross-sectional view of housing 205; FIG. 5B illustrates a view looking up into the housing 205; FIG. 5C illustrates a bottom perspective view of the housing 205; and FIG. 5D illustrates a top perspective view of the housing 205.

Referring to FIGS. 5A-5D, the housing 205 may include a top surface 590 and a side wall 592 that extends downwards from a perimeter of the top surface 592 to a bottom edge 593 of the housing 205 that defines a circular aperture 594. In particular, as illustrated in FIGS. 5A and 5B, the side wall 592 may be substantially curved and may increase in width from the top surface 590 to the bottom edge 593 of the housing 205. Further, the top surface 590 and the side wall 592 may define a cavity 595 that is configured to receive at least a portion of the light module 220. Furthermore, the top surface 590 of the housing 205 may include one or more mounting features 598 (circular features that may be cut out to define an opening, or through holes) that can be used for mounting the housing 205/downlight 200 to a surface or for feeding cables into the housing 205.

As illustrated in FIGS. 5A-5D, the housing 205 may further include a plurality of vertical slots 596 that extend from the bottom edge 593 towards the top surface 590. Each vertical slot 596 may be through slots that extend from the outer surface 592*a* of the side wall 592 through the inner surface 592*b* of the side wall 592. Similarly, the housing 205 may include a plurality of horizontal slots 597 on the top surface 590. Each horizontal slot 597 may be a through slot that extends through the top surface 590. In particular, the horizontal slots 597 may be located adjacent the perimeter of the top surface 590 and extend towards the center of the top surface 590 as illustrated in FIGS. 5B and 5D.

Figure 3A:
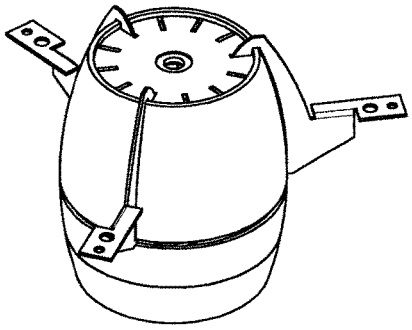
FIGS. 3A-3C illustrate example configurations for extension arms that can be used with the example embodiments described herein.
Figure 3B:
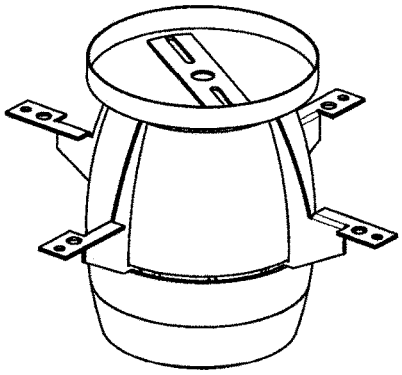
Figure 3C:
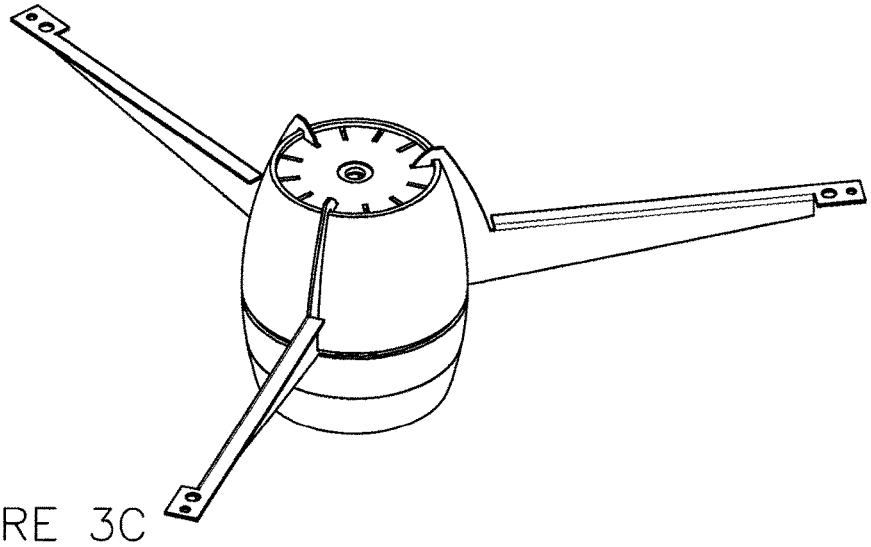

Further, as illustrated in FIGS. 5B and 5D, the vertical slots 592 and the horizontal slots 597 may be aligned such that each vertical slot 596 at the bottom edge 592 of the housing 205 may have a counterpart horizontal slot 597 at the top surface 590 of the housing 205 configured to couple one or more extension arms 210 to the housing 205 as in FIG. 2. That is, the housing 205 may have a plurality of vertical and horizontal slot pairs (596, 597), each pair (596, 597) configured to attach an extension arm 210 to the housing 205. In certain example embodiments, the housing 205 may have twelve vertical slots 596 on the bottom edge 593 and twelve horizontal slots 597 on the top surface 590 to allow three or four extension arms 210 to be coupled to the downlight fixture 100 as illustrated in FIGS. 3A-3C. Even though FIGS. 5A-5D illustrate the housing 205 as having twelve vertical slots 596 on the bottom edge 593 and twelve horizontal slots 597 on the top surface 590, one of ordinary skill in the art can understand that in other example embodiments, the housing 205 may include fewer or more slots without departing from a broader scope of the present disclosure. Further, in some example embodiments, lesser or more than three to four extension arms 210 may be coupled to the downlight fixture 100 without departing from a broader scope of the present disclosure. Furthermore, in some example embodiments, the number of horizontal slots 597 on the top surface 590 may be different from the number of vertical slots 596 on the bottom edge without departing from a broader scope of the present disclosure.

Turning back to FIG. 2, the downlight fixture 200 may include one or more extension arms, for example, extension arms 210*a* and 210*b*. The extension arms 210*a*, 210*b*, etc., may be removably coupled to the housing 205 by engaging the end tabs 211, 212 of each extension arm 210 in respective slot pairs (596, 597) of the housing 205. In certain example embodiments, each arm 210 may have a substantially curved body 290, for example, a C-shaped body having a substantially concave inner edge 292, a substantially convex outer edge 291, a top end 293 and a bottom end 294. In particular, the top end 293 of each arm 210 may be configured as an L-shaped tab 211, where the longer leg 211*a* of the L-shaped tab 211 may be at an angle to the curved body 290 and the shorter leg 211*b* of the L-shaped tab 211 (hereinafter 'top end tab 211') may extend horizontally outward from an end of the longer leg 211*a*. Similarly, the bottom end 294 of each arm 210 may be configured as an L-shaped tab 212, where the longer leg 212*a* of the L-shaped tab may extend out substantially perpendicular to the curved body 290 and the shorter leg 212*b* of the L-shaped tab 212 (hereinafter 'bottom end tab 212') may extend vertically downwards from an end of the longer leg 212*a*.

In certain example embodiments, the tab 211 on the top end 293 of the arm 210 engages a horizontal slot 597 on the top surface of the housing 205 and the tab 212 on the bottom end 294 of the arm 210 engages the vertical slot 596 of the bottom edge 593 of the housing 205. In particular, the tab 211 of the arm 210 may engage the horizontal slot 597 such that a shorter leg 211*b* of the tab 211 biases against a bottom portion of the top surface 590 to secure/lock the arm 210 in position at the top end 294. Similarly the tab 212 of the arm 210 may engage the vertical slot 596 of the housing 205. However, unlike the top end tab 211, the bottom end tab 212 may not be secured or locked in position at the bottom end 294 of the arm 210 until an outer ring 215 is coupled the housing 205 adjacent the bottom edge 593 of the housing 205. In particular, the longer leg 212*a* of the bottom end tab 212 may rest on the outer ring 215, thereby securing the arm 210 at the bottom end 294.

Furthermore, as illustrated in FIG. 2, each arm 210 may also include a flange 213 that may be bent out from the arm 210 and extends outward from the outer edge 291 of the arm 210. The flange 213 may be oriented horizontally and may be substantially perpendicular to the curved body 290 of the arm 210. In particular, the flange 213 may include two through apertures 296, 298, one on each end of the flange 213. That is, one through aperture 296 may be positioned adjacent an end of the flange 213 that is closer to the curved body 290 of the arm 210, and the other through aperture 298 may be positioned adjacent an opposite end of the flange 213 that is away from the curved body 290.

In particular, the flange 213 of each extension arm 210 may be configured to secure to a clip 214, which in turn would couple a shade or a diffuser to the downlight 100 as shown in FIGS. 1C-1E. The process of coupling the downlight 100 to the diffuser or shade via the flange 213 of the extension arm 210 and the clip 214 is described below in greater detail in association with FIG. 7.

Figure 7A:
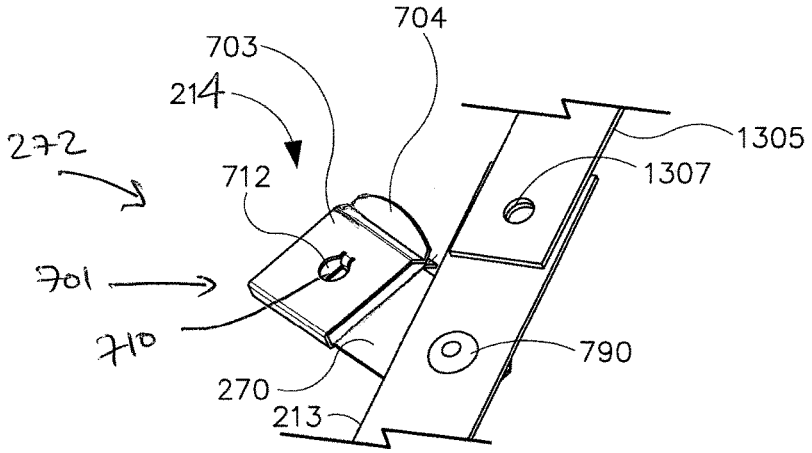
FIGS. 7A-7C (collectively 'FIG. 7') illustrate how different shades and diffusers are coupled to the downlight using the extension arm and a clip, in accordance with the example embodiments described herein.

Turning now to FIG. 7, this figure illustrates how different shades and diffusers are coupled to the downlight using the extension arm and a clip, in accordance with the example embodiments described herein. In particular, as illustrated in FIGS. 2 and 7A, the clip 214 may have a substantially rectangular body 270. Further, the clip 214 may include a through aperture 271 positioned adjacent a first lateral end of the body 270 and a clip head 272 positioned at the second lateral end of the body 290, where the second lateral end is opposite to the first lateral end. Even though the present disclosure describes the clip as having a rectangular shaped body having a through aperture and a clip head on opposite ends of the body, one of ordinary skill in the art can understand and appreciate that in other embodiments, the clip may have any other shape without departing from a broader scope of the present disclosure.

In certain example embodiments, the clip head 272 of the clip 214 may include a main body 701 consisting of a single piece of spring steel having a bottom portion 702 and a top portion 703 that converge at one end. In particular, the bottom portion 702 may be substantially aligned and flush with the body 270 of the clip 214 and may include a through aperture 710. Further, the top portion 703 may be positioned above the bottom portion 702 such that a through aperture 712 of the top portion 703 is axially aligned with the through aperture 710 of the bottom portion 702. Furthermore, the clip head 272 may include a tab 704 that extends from the top portion 703 and acts as a lever to spread or push the top portion 702 away from the bottom portion 702 by applying pressure on the tab 704 against a tension of the spring steel. When the pressure is released the top portion 703 may return to its default state, i.e., closer to the bottom portion 702. One of ordinary skill in the art can understand and appreciate that in other embodiments the clip head may be replaced by any other appropriate coupling mechanism without departing from a broader scope of the present disclosure.

As illustrated in FIG. 7A, the clip 214 may be pivotally coupled to the flange 213 of an extension arm 210 by: (i) aligning the through aperture 271 adjacent a first lateral end of the clip 214 with a through aperture 296 of the flange 213 that is closer to the curved body 290 of the arm 210, and (ii) passing a fastener 790 (e.g., rivet) through the aligned through apertures (271, 296) of the clip 214 and the arm flange 213. In particular, the clip 214 may pivot about the fastener 790, i.e., the point about which the clip 214 is coupled to the flange 213.

Figure 7B:
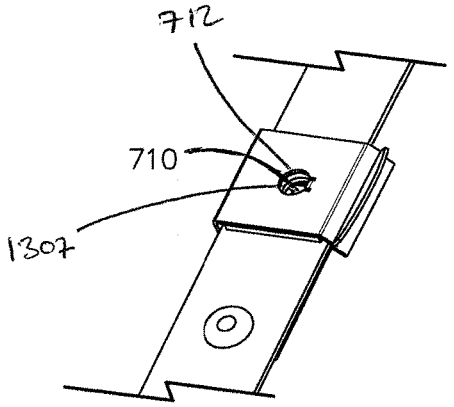

Further, as illustrated in FIG. 7A, to connect various shades and diffusers to the downlight 100, a flange 1305 of the diffuser or shade may be placed adjacent to an end of the extension arm flange 213 that is away from the curved body 290 of the extension arm 210 such that the through aperture 298 of the arm flange 213 is axially aligned with a through aperture 1307 of the diffuser/shade flange 1305. Once the flange 1305 of the diffuser or shade is aligned with the extension arm flange 213 as described above, the clip 214 may be pivoted about the fastener 790 towards the end of the diffuser/shade flange 1305 that is aligned with the extension arm flange 213 such that the clip head 272 engages and locks the arm flange 213 and the diffuser/shade flange 1305 in position. In particular, the arm flange 213 and the diffuser/shade flange 1305 may be sandwiched between the top and bottom portion (703, 702) of the clip head 272 as illustrated in FIG. 7B.

Figure 7C:
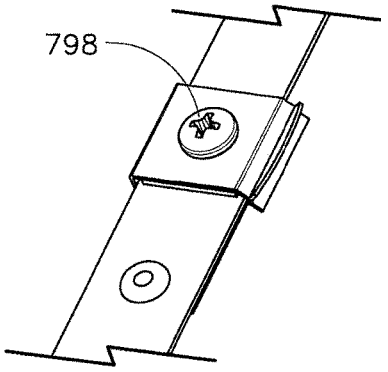

In certain example embodiments, in order to engage and lock the aligned arm flange 213 and the diffuser/shade flange 1305 in position, the top portion 703 of the clip head 272 may be spread or pushed away from the bottom portion 702 by applying pressure on the tab 704. Further, the clip head 272 is pushed to slide over the aligned arm flange 213 and the diffuser/shade flange 1305. Subsequently the pressure on the tab 704 is released which causes the top portion 703 of the clip head 272 to snap back to default portion sandwiching the arm flange 213 and the diffuser/shade flange 1305 in between the top portion 703 and the bottom portion 702 of the clip head 272. In particular, as illustrated in FIG. 7B, the bottom portion 702 of the clip head 272 biases the arm flange 213 and the top portion 703 of the clip head 272 biases the diffuser/shade flange 1305 such that the through aperture 712 (top portion 703) of the clip head 272, the through aperture 1307 of the diffuser/shade flange 1305, the through aperture 298 of the arm flange 213, and the through aperture 710 (bottom portion 702) of the clip head 272 are axially aligned. Further, as illustrated in FIG. 7C, a fastener 798 (e.g., screw) may be passed through the axially aligned apertures (712, 1307, 298, and 710) of the clip head 272, arm flange 213, and the diffuser/shade flange 1305 to secure the diffuser/shade to the downlight 100 via the extension arm 210.

Turning now to FIGS. 6A-6D (collectively 'FIG. 6'), these figures illustrate various views of the outer ring, in accordance with the example embodiments described herein. In particular, FIG. 6A illustrates a view looking up (bottom view) into the outer ring 215; FIG. 6B illustrates a cross-sectional view of outer ring 215; FIG. 6C illustrates a top perspective view of the outer ring 215; and FIG. 6D illustrates a bottom perspective view of the outer ring 215.

Referring to FIGS. 6A-6D, the outer ring 215 may include a bottom annular edge 602 that defines a first opening 690, a top annular edge 604 that is opposite to the bottom annular edge 602 and that defines a second opening 692, and a ring body 606 that extends from the bottom annular edge 602 to the top annular edge 604. Further, the ring body 606 may include an outer surface 606*a* and an inner surface 606*b* that is opposite to the outer surface 606*a*.

In particular, the inner surface 606*b* of the outer ring 215 may be indexed to couple a light module 220 to the housing 205 by a twist lock mechanism. However, in other example embodiments, any other appropriate coupling mechanism may be used to secure the light module 220 within the housing assembly 201. As illustrated in FIG. 6, the inner surface 606*b* of the outer ring 215 may include at least (i) one or more ledges 920 that protrude radially inwards from the inner surface 606*b* towards the center of the outer ring 215, (ii) an index friction stop 915 tab that protrudes radially inward from the inner surface 606*b* towards the center of the outer ring 215, (iii) one or more support tabs 612 extending radially inward from inner surface 606 adjacent the bottom annular edge 604 of the outer ring 215, and (iv) a plurality of coupling tabs 620, 622, 624 disposed adjacent to or extending upwards from the top annular edge 604 of the outer ring 215, each having apertures 912, 911, and 910, respectively.

Figure 11A:
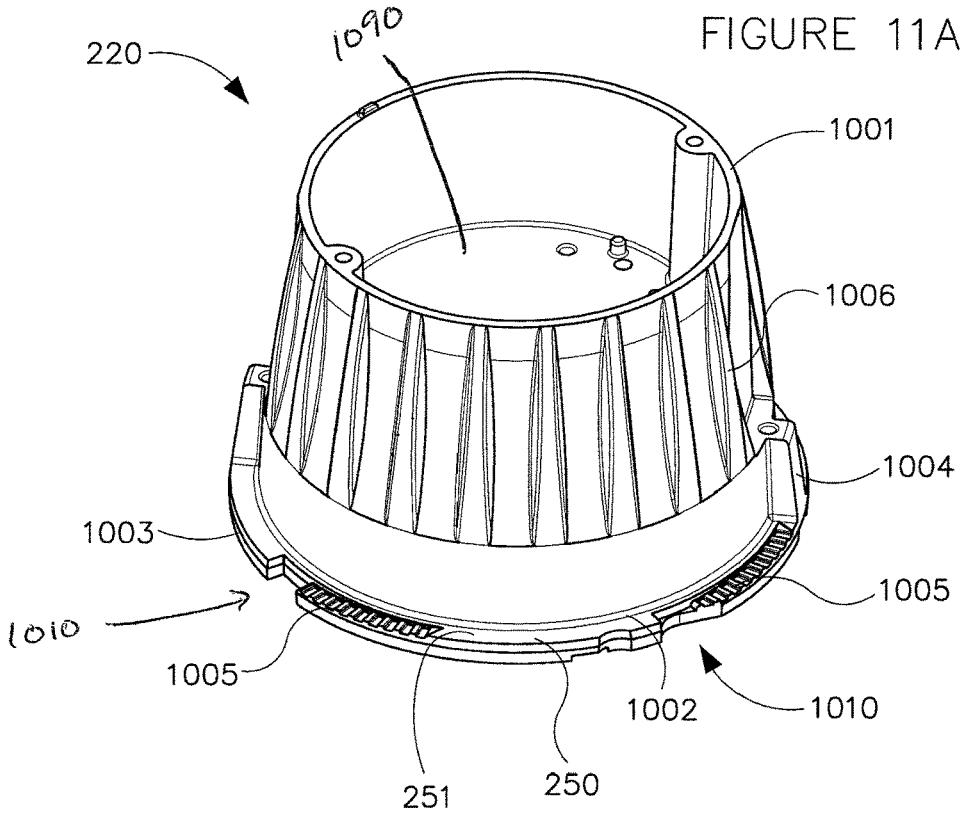
FIGS. 11A and 11B (collectively 'FIG. 11') illustrate a top perspective view and a bottom perspective view of the light module of the downlight, in accordance with the example embodiments described herein.

The one or more ledge features 920 may be configured to interface with a collar 250 (shown in FIG. 2 and FIG. 11) of the light module 220 (disposed near a bottom portion of the light module 220) and prevent the light module 220 from being inserted too far into the housing 205. As illustrated in FIG. 11A, the collar 250 of the light module 220 may include a notch 1010 and a ramped surface 1005 proximate the notch 1010. The notch 1010 and the ramped surface 1005 may enable alignment and installation of the light module 220 in the outer ring 215 of the housing assembly 201.

In particular, the light module 220 may be installed (twist locked) within the outer ring 215 by aligning the notch 1010 of the light module 220 with its corresponding support tab 612 of the outer ring 215. The light module 1010 is then moved up from the bottom annular edge 602 towards the top annular edge 604 of the outer ring 215 until a top surface 251 of the light module collar 250 biases the one or more ledges 920. Once in place, the light module 220 and/or the outer ring 215 are rotated (twisted) such that: (i) the bottom edge 915*b* of the index friction stop 915 of the outer ring 215 travels up the corresponding ramped surface 1005 of the light module 220, and (ii) the bottom surface 252 of the light module collar 250 biases the top of the one or more support tabs 612. Each ramped surface 1005 has a height that slowly rises along the collar 250 of the light module 220. As the bottom edge 915*b* of the index friction clip 915 engages the ramped surface 1005, and bottom surface 252 of the light module collar 250 biases the support tabs 612, the light module 220 is twist locked and coupled to the outer ring 215. Furthermore, the top portion 915*a* of the index friction stop 915 tab may prevent a free rotation of the light module 220 within the outer ring 215 and/or the housing 205.

Figure 12A:
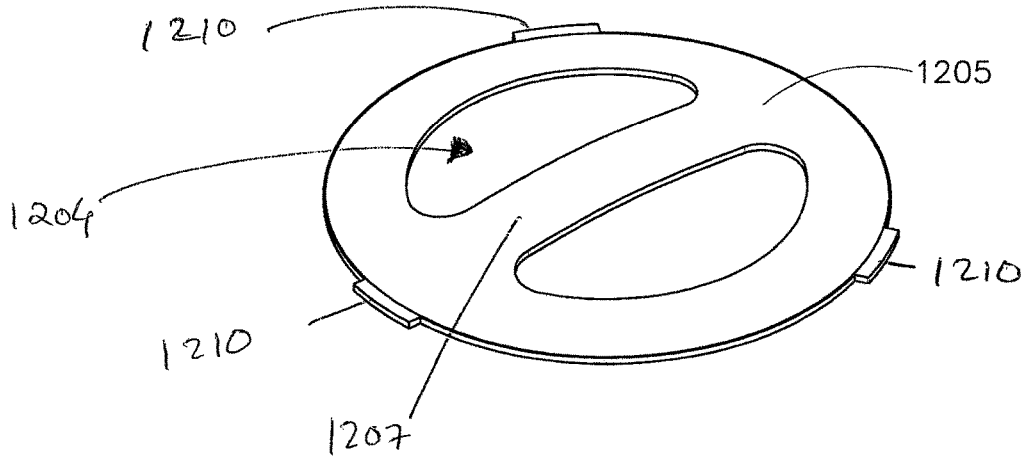
FIGS. 12A and 12B (collectively 'FIG. 12') illustrate an installation and remove tool that can be used for installing the light module in and removing the light module from the downlight housing, in accordance with the example embodiments described herein.
Figure 12B:
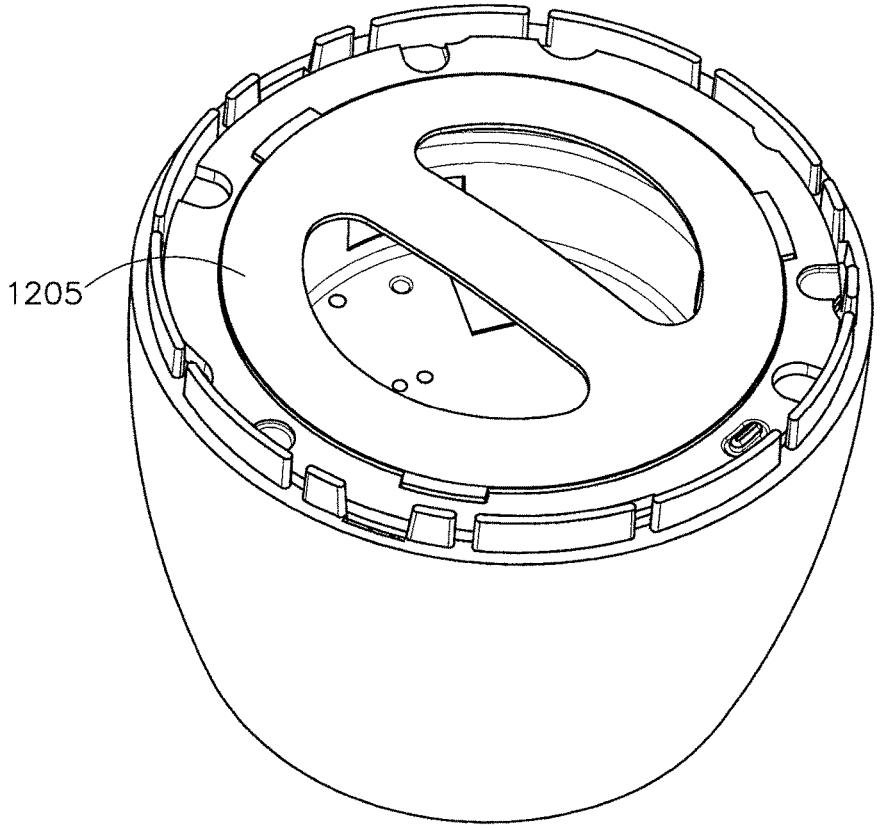

Turning to FIG. 12, in certain example embodiments, the light module 220 may be twisted and locked into the outer ring 215 of the housing assembly 201 by using an installation and removal tool 1205 (herein 'tool 1205') illustrated in FIG. 12B. That is, the tool 1205 may allow a user to easily engage and disengage the light module 220 from the housing 205. The tool 1205 may be a ring shaped member that defines a central circular opening 1204. In particular, the tool 1205 may have a bridge feature 1207 that extends along the center of the tool 1205 dividing the central circular cavity 1204 into two parts. Further, the tool 1205 may include one or more protrusions 1210 that are configured to engage with corresponding notches 253 positioned on an inner surface 254 of the light module 220 and adjacent a bottom surface 252 of the housing module collar 250. Once the protrusions 1010 of the tool 1005 engages with the corresponding notches 253 of the light module 220, a movement of the light module 220 is locked in step with a corresponding movement of the tool 1005. That is, if the tool 1005 is rotated clockwise, the light module 220 also rotates clockwise; and if the tool is rotated counterclockwise, the light module 220 also rotates counterclockwise. The bridge feature 1007 of the tool 1005 may be used as leverage by a user to easily twist and lock the light module 220 into the housing without having to touch the light module 220, e.g., a light source of the light module 220 which may result in damaging the light source. One of ordinary skill in the art can understand and appreciate that a use of the tool 1005 to engage and disengage the light module 220 from the housing 205 may be optional. That is, in other example embodiments, a user may directly hold the light module with his/her hands and twist and lock the light module 220 into the housing 205 without using a tool 1005.

Turning back to FIG. 6, the outer ring 215 may be coupled to the housing 205 to form the housing assembly 201 by: (i) aligning the coupling tabs 620, 622, 624 of the outer ring 215 with corresponding screw bosses 206, 207, and 208 of the housing 205 such that the apertures 912, 911, and 910 of the plurality of coupling tabs 620, 622, and 624 are axially aligned and their respective apertures of the screw bosses 206, 207, and 208, and (ii) passing fasteners (screws, rivets, etc.) through the aligned apertures of the outer ring coupling tabs 620, 622, 624 and the housing screw bosses 206, 207, and 208.

Turning now to FIG. 11, the light module 220 may include a body 1006 that extends from a top annular edge 1001 to the bottom annular edge 1002. In particular, the body 1006 may include features, such as fins, that provide additional surface area to the body 1006 for dissipating heat generated by one or more light sources coupled to the light module 220. The light module 220 may further include a mounting surface 1090 that is disposed in between the top annular edge 1001 and the bottom annular edge 1002. The mounting surface 1090 may include one or more through apertures 1020 that are configured to facilitate coupling of one or more light sources or electrical wires, for example LED light sources and corresponding electrical wires from LED drivers or external power supplies, to the light module 220. In particular, the light source may be coupled to the mounting surface 1090 such that the light emitted by the light source may be directed downward towards the lens 235 through the openings of the reflector 225.

LED light sources can take a variety of forms including, single LEDs, arrays of discrete LEDs, and chip-on-board LEDs. LEDs typically offer advantages over traditional light sources such as increased energy efficiency, durability, and cost-effectiveness. LEDs also offer the advantage of typically being more compact than incandescent or other conventional light sources. In alternate embodiments, other light sources can be used with the downlight including organic LEDs, incandescent, and fluorescent light sources.

In addition to the body 1006 and the mounting surface 1090, the light module 220 may include a collar 250 that extends radially out from the bottom annular edge 1002 to an outer annular edge 1003. The collar 250 may have a top surface 251 and a bottom surface 252. Additionally, the light module 220 may include one or more mounting pads 1004 that extend radially outward from the body 1006 of the light module 220 and are configured to mount the light module 220 to a mounting surface or to receive torsion spring brackets for recess mounting the light module 220.

Figure 9:
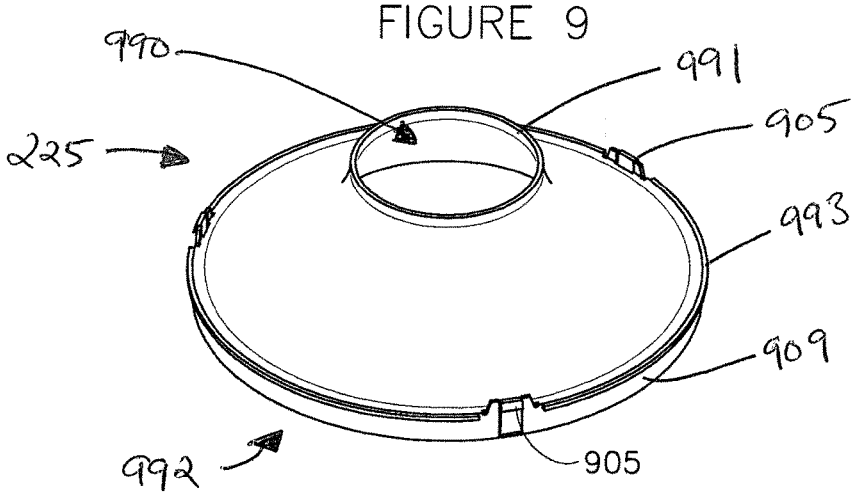
FIG. 9 illustrates a perspective view of a reflector of the downlight, in accordance with the example embodiments described herein.

Furthermore, the light module may include a reflector 225 illustrated in FIG. 9. The reflector 225 may include a top edge 991 that defines a top opening 990, a bottom edge 993 that defines a bottom opening 992, and a body 995 that extends between the top edge 991 and the bottom edge 993. In particular, the reflector 225 may be disposed within the light module 220 such that the light from the light source of the light module 220 may be enter the reflector 225 through the top opening 990 and exit the light module 220 through the bottom opening 992. Further, the inner surface of the reflector body 995 may be made reflective to reflect light towards the lens 235.

Figure 10:
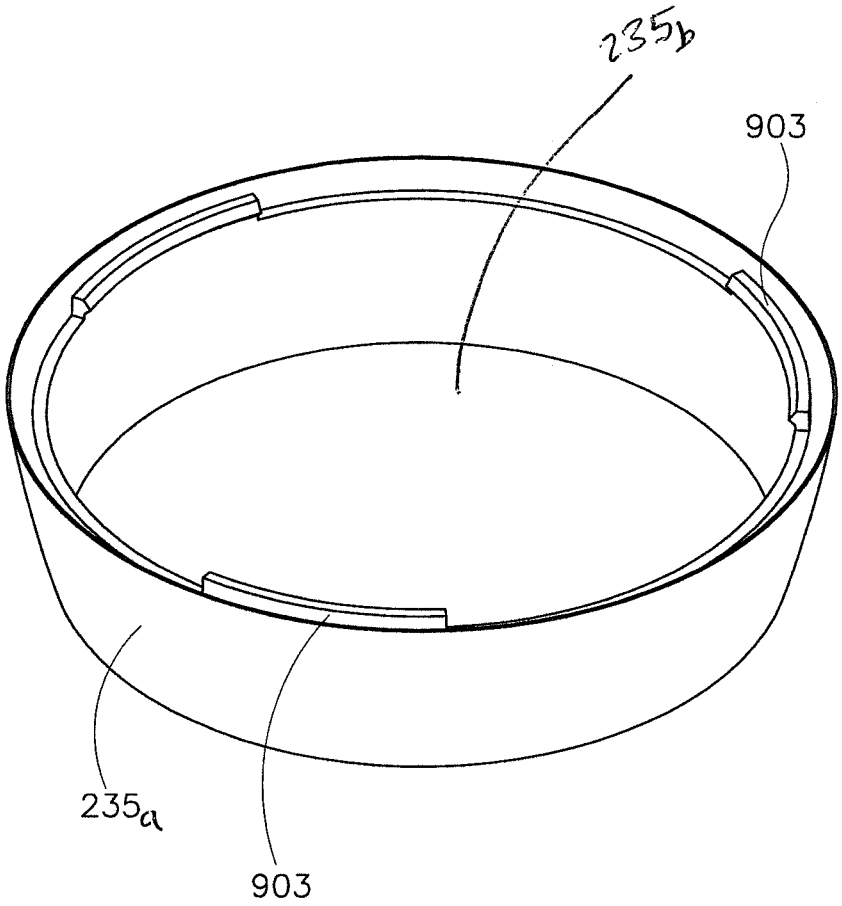
FIG. 10 illustrates a perspective view of the lens of the downlight, in accordance with the example embodiments described herein.
Figure 11B:
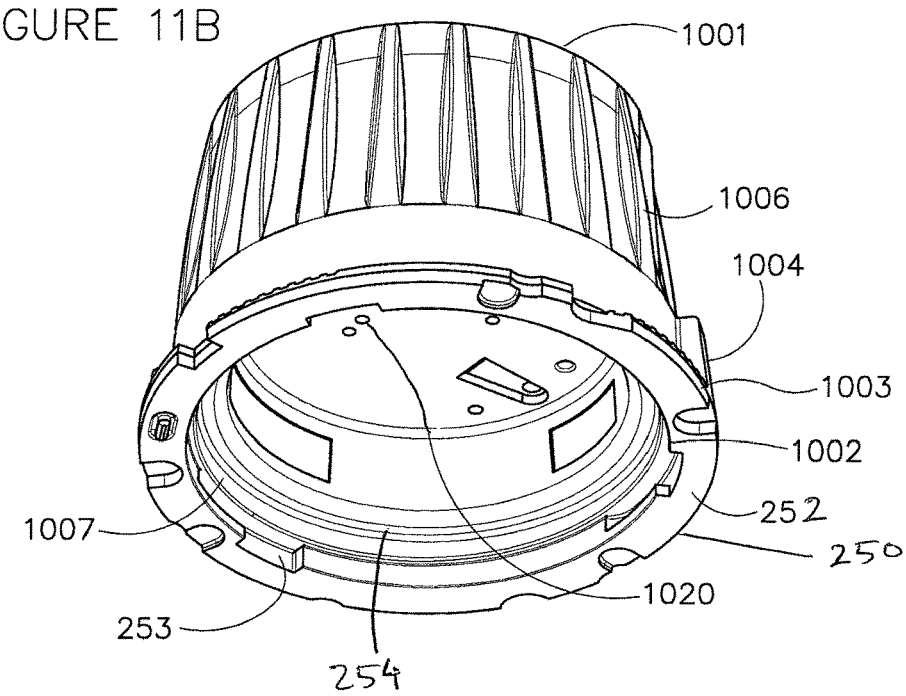

As illustrated in FIG. 11B, the inner surface 254 of the light module 220 may include an inner ledge 1007 that extends inward from the body 1006 of the light module 220 towards the center of the light module 220 and a notch 253. The inner ledge 1007 and the notch 253 may be configured to couple the twist lock ring 230, and in turn, the lens 235 and the reflector 225 with the light module 220. The twist lock ring 230, the lens 235, and the reflector 225 may be described in greater detail below in association with FIGS. 8-10.

Figure 8:
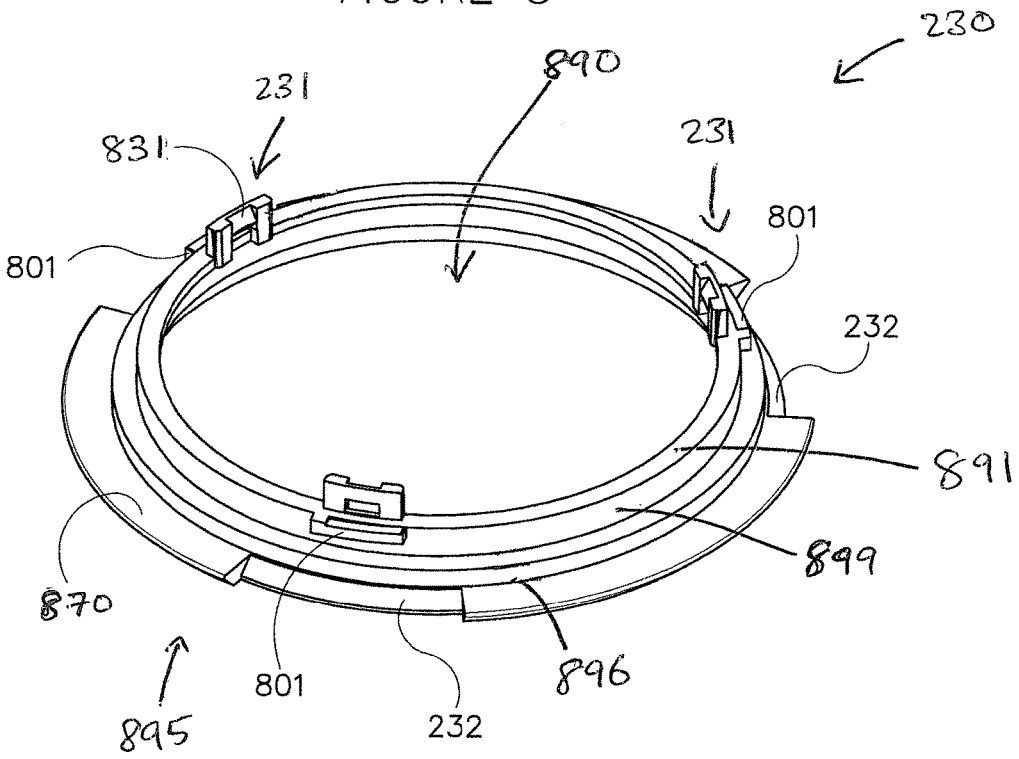
FIG. 8 illustrates a perspective view of the twist lock ring of the downlight, in accordance with the example embodiments described herein.

Turning to FIGS. 8-10, the twist lock ring 230 may include a top annular edge 891 that defines an top opening 890, a bottom annular edge 896 that defines a bottom opening 895, and a body 899 that extends from the top annular edge 891 to the bottom annular edge 896. Further, the twist lock ring 230 may include a collar 870 that extends radially outward from segments of the bottom annular edge 896.

Furthermore, the twist lock ring 230 may include bottom attachment features 232 that are disposed in between the collar segments 870 of the twist lock ring 230. The bottom attachment features 232 may be a ledge that is configured to engage with corresponding features, e.g., coupling tabs 903 (shown in FIG. 10) of a lens 235 to secure the lens 235 to the twist lock ring 230. The lens 235 will be described in greater detail below in association with FIG. 10.

Turning to FIG. 10, the lens 235 may be a drop lens that has one or more coupling tabs 903 that extend radially inward from a top annular edge of the lens 235. In certain example embodiments, as described above, the coupling tabs 903 of the lens may be configured to engage the bottom attachment features 232 of the twist lock ring 230. However, in other example embodiments, the coupling tabs 903 of the lens 235 may be configured to engage the collar 250 of the light module 220 for coupling directly to the light module 220.

The lens 235 may be fabricated using a variety of translucent materials including glass, acrylic, or polycarbonate. In particular, the lens 235 may be designed to distribute light horizontally as well as vertically, and further the lens may be configured to spread the light emitted from the light module 220 to provide a more softer light output from the downlight fixture 100. For example, the lens 235 (e.g., the side surface 235*a* and bottom surface 235*b*) may be coated with a white reflective paint that provides both reflective and diffuser properties to the lens 235. Accordingly, the lens 235 may allow a portion of light from the light module 220 to pass through in a direction of the area to be illuminated, while a remaining portion of light from the light module 220 may be reflected/redirected towards another direction that is away from the area to be illuminated. That is, the lens 235 may be designed such that it provides downlight, uplight, and/or side light. The ratio of downlight to uplight or side light may vary based on the design and/or material (or coating) of the lens 235. In one or more example embodiments, a majority of light from the light module 220 may exit the downlight fixture 100 as downlight, and small percentage of light (remainder of the light), for example, 10%-20% of the light may exit the downlight fixture 100 as uplight and/or side light.

Figure 4A:
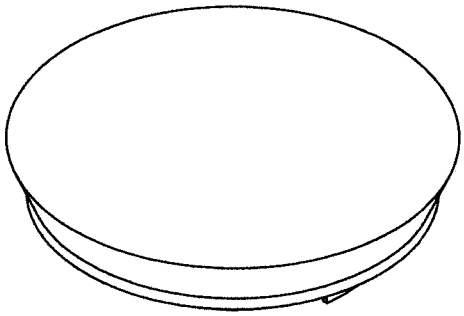
FIGS. 4A-4C illustrate example lenses coupled to twist lock rings that can be used with the example embodiments described herein.
Figure 4B:
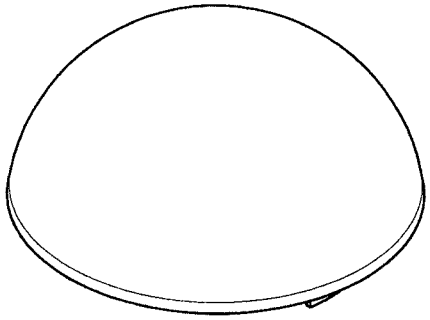
Figure 4C:
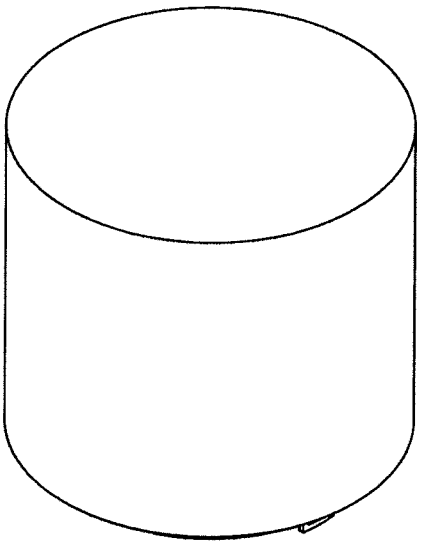

Even though FIGS. 2 and 10 of the present disclosure illustrate a lens 235 having a specific shape and design, one of ordinary skill in the art can understand and appreciate that in other example embodiments, the downlight fixture may include lenses having any other appropriate shape or design without departing from a broader scope of the present disclosure. Other examples of lenses that can be used with the downlight fixture 100 described herein are shown in FIGS. 4A, 4B, and 4C (collectively 'FIG. 4').

Turning back to FIG. 8, in addition to the bottom attachment features 232, the twist lock ring 230 may include one or more top attachment features 831. In particular, each top attachment feature 831 may include a reflector snap tab 231 that is configured facilitate coupling of the reflector 225 to the twist lock ring 230. As illustrated in FIG. 9, the reflector 225 may include a collar 909 that extends vertically downwards from a bottom annular edge of the reflector 225. Further, the collar 909 may include one or more attachment features 905 that are configured to mate with the reflector snap tab 231 such that the twist lock ring 230 snaps in the reflector 225 of the light module 220 to the top of the twist lock ring 230. As illustrated in FIG. 8, the reflector snap tab 231 of the twist lock ring 230 extends vertically upwards from the top annular edge 891 of the twist lock ring 230.

Each top attachment feature 831 further includes a twist lock tab 801 that is disposed adjacent to and below the reflector snap tab 231 on an outer surface of the twist lock ring body 899. The twist lock ring 230 may be coupled to the light module 220 by aligning the twist lock tabs 801 of the twist lock ring 230 with its corresponding notches 253 in the inner surface 254 of the light module 220. The twist lock ring 230 is then moved up from the bottom annular edge 1002 towards the top annular edge 1001 of the light module 220 till the top annular edge 891 of the twist lock ring 230 biases the inner ledge 1007 of the light module 220 and the collar 870 of the twist lock ring biases the bottom annular edge 602 of the outer ring 215. Once in place, the twist lock ring 230 is twisted or rotated such that the twist lock ring 230 is locked with the light module 220. Provided the lens 235 and the reflector 225 is attached to the twist lock ring 230 as described above, coupling the twist lock ring 230 to the light module 220 indirectly couples the lens 235 and the reflector 225 to the light module 220 as well. Further, as illustrated in FIG. 2, the light module 220, the reflector 225, and the inner ring 230 may fit within the housing assembly 201. Even though the present disclosure describes the twist lock ring as being coupled to the light module using a twist-lock mechanism at the top and the lens at the bottom, in other example embodiments, the twist lock ring may be replaced by any other appropriate coupling mechanisms to couple the lens and/or reflector to the light assembly 220 and/or the housing assembly 201 without departing from a broader scope of the present disclosure.

The present disclosure describes example embodiments and it should be appreciated by those skilled in the art that various modifications are well within the scope of the disclosure. From the foregoing, it will be appreciated that an embodiment overcomes the limitations of the prior art. Those skilled in the art will appreciate that the embodiments are not limited to any specifically discussed application and that the embodiments described herein are illustrative and not restrictive. From the description of the example embodiments, equivalents of the elements shown therein will suggest themselves to those skilled in the art, and ways of constructing other embodiments will suggest themselves to practitioners of the art.

I claim:

1. A luminaire comprising a downlight, wherein the downlight comprises:

a housing assembly that is configured to secure one or more extension arms to the housing assembly, the housing assembly comprising:

a housing, wherein the housing comprises a top wall and a side wall that extends downward from a perimeter of the top wall to a bottom edge, wherein the top wall of the housing comprises upper through slots and the side wall of the housing comprises lower through slots that correspond to and align with the upper through slots, wherein the one or more extension arms are removably attached to the upper through slots and the lower through slots of the housing to couple the one or more extension arms to the housing assembly, and wherein each extension arm of the one or more extension arms comprises:

a body defined by an inner edge and an outer edge, and a flange that is integral to the body and protrudes radially outward from the outer edge; and an outer ring that is disposed below and removably coupled to the housing, wherein the one or more extension arms are secured to the housing assembly when the outer ring is removably coupled to the housing, and wherein the one or more extension arms and the outer ring are separable from each other;

a light module that is received and securely retained within the housing assembly;

a twist lock ring that is coupled to an inner surface of the light module; and a lens that attaches to the twist lock ring.

2. The luminaire of claim 1, wherein the lens is a drop lens that is configured to distribute a portion of light from the light module downwards and a remaining portion of the light in at least one of an upward direction and a sideways direction.

3. The luminaire of claim 1, wherein the one or more extension arms are configured to couple a shade or a diffuser to the luminaire.

4. The luminaire of claim 1, further comprising a shade attached to the one or more extension arms.

5. The luminaire of claim 1, wherein the light module comprises a light source, a heat sink, and a reflector.

6. The luminaire of claim 5, wherein the twist lock ring includes a bottom attachment feature and a top attachment feature, wherein the reflector of the light module is coupled to the top attachment feature of the twist lock ring, and wherein the lens is coupled to the bottom attachment feature of the twist lock ring.

7. The luminaire of claim 1, wherein an inner surface of the outer ring is indexed to twist and lock the light module to the housing assembly.

8. The luminaire of claim 1, wherein the light module includes:

a body extending from a top edge to a bottom edge of the light module; and a collar extending radially outward from the bottom edge of the light module, wherein the collar includes a notch and a ramped surface adjacent the notch.

9. The luminaire of claim 8, wherein the outer ring includes an index friction stop tab that engages the ramped surface of the light module to couple the light module to the outer ring.

10. A luminaire comprising:

a shade;

a downlight comprising:

a housing assembly;

a light module mounted within the housing assembly; and a lens coupled to the housing assembly; and one or more extension arms securing the shade to the downlight, wherein the one or more extension arms are removably coupled to the housing assembly by an outer ring of the housing assembly, and wherein the outer ring includes an index friction stop tab that engages a ramped surface of the light module to couple the light module to the housing assembly.

11. The luminaire of claim 10, wherein the housing assembly includes a housing and the outer ring that is disposed below and removably coupled to the housing.

12. The luminaire of claim 10, wherein the lens is secured to the housing assembly by a twist lock ring.

13. The luminaire of claim 10, wherein the one or more extension arms couple to upper slots and lower slots in a housing of the housing assembly.

14. The luminaire of claim 10, wherein the light module comprises a light source, a heat sink, and a reflector.

15. The luminaire of claim 12, wherein the twist lock ring includes a bottom attachment feature and a top attachment feature, wherein a reflector of the light module is coupled to the top attachment feature of the twist lock ring, and wherein the lens is coupled to the bottom attachment feature of the twist lock ring.

16. The luminaire of claim 10, wherein the lens is a drop lens.

17. The luminaire of claim 10, wherein an inner surface of the outer ring is indexed to twist and lock the light module to the housing assembly.

* * * * *